US007775408B2

(12) United States Patent
Yamamoto et al.

(10) Patent No.: US 7,775,408 B2
(45) Date of Patent: Aug. 17, 2010

(54) HEAD CAP FOR AEROSOL TYPE ATOMIZER

(75) Inventors: Kazunori Yamamoto, Hatsukaichi (JP); Shin Kanematsu, Hatsukaichi (JP); Satoshi Yamasaki, Hatsukaichi (JP)

(73) Assignee: Fumakilla Limited, Tokyo (JP)

( * ) Notice: Subject to any disclaimer, the term of this patent is extended or adjusted under 35 U.S.C. 154(b) by 355 days.

(21) Appl. No.: 11/795,905

(22) PCT Filed: Jan. 18, 2006

(86) PCT No.: PCT/JP2006/301079

§ 371 (c)(1),
(2), (4) Date: Aug. 31, 2007

(87) PCT Pub. No.: WO2006/080320

PCT Pub. Date: Aug. 3, 2006

(65) Prior Publication Data

US 2009/0039114 A1 Feb. 12, 2009

(30) Foreign Application Priority Data

Jan. 26, 2005 (JP) ..... 2005-018581

(51) Int. Cl.
*B65D 83/00* (2006.01)

(52) U.S. Cl. ..... 222/402.14; 222/153.12; 222/402.11; 222/402.13

(58) Field of Classification Search ..... 222/153.06, 222/153.11, 153.12, 402.11, 402.13, 402.14
See application file for complete search history.

(56) References Cited

U.S. PATENT DOCUMENTS 3,738,537 A * 6/1973 Gach ..... 222/153.11

(Continued)

FOREIGN PATENT DOCUMENTS

JP 55-73700 11/1953

(Continued)

OTHER PUBLICATIONS

Notification Concerning Transmittal of International Preliminary Report on Patentability, Chapter I of the Patent Cooperation Treaty for PCT/JP2006/301079, 4 sheets.

(Continued)

*Primary Examiner*—Kevin P Shaver
*Assistant Examiner*—Andrew P Bainbridge
(74) *Attorney, Agent, or Firm*—Frishauf, Holtz, Goodman & Chick, P.C.

(57) ABSTRACT

A head cap for an aerosol type atomizer is proposed in which a residual gas that remains in the container after the use of the aerosol type atomizer is ended are discharged easily and safely, and which is so structured that the aerosol type atomizer cannot be falsely operated while it is being used. It comprises a cap body mounted over a top of a container accommodating its contents, and a movable member for spray operation disposed inside of the cap body and having a fluid channel extending from a stem fitting part for fitting with a stem and leading to a spray port, the movable member for spray operation having a push button such that pushing down the push button to take a spray position sprays contents of the container from the spray port via the fluid channel, wherein the cap body has a side face elastically deformable so that when the push button of the movable member for spray operation is pushed down to take the spray position, pressing the side face of the cap body inwards locks the movable member for spray operation with the side face to hold the movable member for spray operation at the spray position.

2 Claims, 10 Drawing Sheets

U.S. PATENT DOCUMENTS

| | | | | |
|---|---|---|---|---|
| 3,760,988 | A * | 9/1973 | Ostrowsky | 222/153.11 |
| 3,894,665 | A * | 7/1975 | Swenson | 222/402.11 |
| 4,243,161 | A * | 1/1981 | Ewald | 222/402.14 |
| 5,388,712 | A * | 2/1995 | Brody | 215/229 |
| 5,791,524 | A * | 8/1998 | Demarest | 222/153.06 |
| 2004/0164103 | A1 * | 8/2004 | Uemura et al. | 222/402.14 |

FOREIGN PATENT DOCUMENTS

| | | | |
|---|---|---|---|
| JP | 1-61082 | U | 4/1989 |
| JP | 4-124918 | U | 11/1992 |
| JP | 6-39782 | U | 5/1994 |
| JP | 8-011956 | A | 1/1996 |
| JP | 8-169480 | A | 7/1996 |

OTHER PUBLICATIONS

Extended European Search Report dated Mar. 28, 2008, issued in a counterpart European Application.

* cited by examiner

HEAD CAP FOR AEROSOL TYPE ATOMIZER

This application is a U.S. National Phase Application under 35 USC 371 of International Application PCT/JP2006/301079 filed Jan. 18, 2006.

TECHNICAL FIELD

The present invention relates to a head cap for an aerosol type atomizer and, more particularly, to a cap head for an aerosol type atomizer in which when all the contents in a container of the aerosol type atomizer are sprayed and used up (when the use of the aerosol type atomizer is ended), a residual gas that remains in the container can be discharged.

BACKGROUND ART

An aerosol type atomizer is made of a container accommodating its contents such as a chemical in its inside, and a head cap mounted over a top of the container.

The container which accommodates its contents such as a chemical and a gas in its inside in a sealed state is provided at its top end with a stem, which is biased upwards, can be pushed down and is structured so that when the stem is pushed down, the contents of the container may be discharged therethrough.

On the other hand, the cap head which is mounted over the top of the container is made of a cap body mounted over the top of the container, and a movable member for spray operation which is disposed inside of the cap body and which can be pivoted and swung vertically relative to the cap body. The movable member for spray operation is provided with a stem fitting part for fitting with the stem and with a spray port, has a fluid channel extending from the stem fitting part to the spray port and is provided with a push button.

In the aerosol type atomizer so made up, it is designed that pushing down the movable member for spray operation to take a spray position causes the contents of the container under the pressure of the gas accommodated in the container to be sprayed externally from the spray port via the fluid channel in the movable member for spray operation.

In such an aerosol type atomizer, when all the contents of the container are sprayed and used up (when the use of the aerosol type atomizer is ended), there is very often the case that the gas remains in the container of the aerosol type atomizer. For this reason, when the aerosol type atomizer is discarded and scrapped, there is a fear of accident that an explosion may occur due to the gas that remains in the container, namely the residual gas.

Then, in order to get rid of an accident of explosion due to the residual gas in an aerosol type atomizer, it has been known as disclosed in JP U S55-73700 and JP U H04-124918, to provide the aerosol type atomizer with a needle or a drilling tool for drilling its container so that when the use of the aerosol type atomizer is ended a hole is drilled in the container with the needle or drilling tool to discharge the residual gas inside of the container therethrough, thereby avoiding the accident of explosion due to the residual gas.

Also, as disclosed in JP U H01-61082, it has been known to provide a mechanism such that when the movable member for spray operation is largely moved downwards in the head cap, the movable member for spray operation is engaged with the cap body to fix the movable member for spray operation at a lower position (in a state of spray) whereby in a time of normal spray the contents of the container are sprayed from the spray port by lowering slightly the movable member for spray operation, but once the use of the aerosol type atomizer is ended, the movable member for spray operation is largely moved downwards by pushing it intensely to fix it at the lower position (in the state of spray), thereby permitting the residual gas in the container to be fully discharged.

In the former type of the conventional aerosol type atomizers, the need to provide the atomizer separately with the needle or drilling tool for drilling the container gives rise to the problem of increasing the number of parts and components to form the aerosol type atomizer. In addition, the need for its use to remove the needle or drilling tool from the aerosol type atomizer and then to pierce the container therewith has the problem of its operation being very troublesome, and yet piercing the container may cause the residual gas in the container to fly about, presenting the problem that the operation may be attended with a danger.

On the other hand, the latter can largely alleviate the problems of the operation being troublesome and becoming hazardous as in the former in that the residual gas in the container is discharged by moving the movable member for spray operation in the head cap largely downwards to fix it at the lower position (in the state of spray), but since the movable member for spray operation can be automatically fixed at the lower position (brought in the state of spray) by pushing it intensely, there is a risk that the problem arises that a false operation to push the movable member for spray operation intensely by just an inadvertence in a time of normal spray may cause the movable member for spray operation to be so fixed automatically with the result that the contents in the container are altogether sprayed.

It is an object of the present invention to provide a head cap for an aerosol type atomizer in which the problems mentioned above are overcome, especially in which a residual gas that remains in the container after the use of the aerosol type atomizer is ended is discharged easily and safely, and which is so structured that the aerosol type atomizer cannot be falsely operated while it is being used.

DISCLOSURE OF THE INVENTION

There is provided in accordance with the present invention a head cap for an aerosol type atomizer, comprising a cap body mounted over a top of a container accommodating its contents, and a movable member for spray operation disposed inside of the cap body and having a fluid channel extending from a stem fitting part for fitting with a stem and leading to a spray port, the movable member for spray operation having a push button such that pushing down the push button to take a spray position sprays contents of the container from the spray port via the fluid channel, characterized in that the cap body has a side face elastically deformable so that when the push button of the movable member for spray operation is pushed down to take the spray position, pressing the side face of the cap body inwards locks the movable member for spray operation with the side face to hold the movable member for spray operation at the spray position.

There is provided in accordance with the present invention a head cap for an aerosol type atomizer as in the aspect mentioned above, characterized in that the cap body has side faces at its right and left hand sides elastically deformable so that when the push button of the movable member for spray operation is pushed down to take the spray position, pressing the side faces at the right and left hand sides inwards in a grasping manner locks the movable member for spray operation with the side faces at the right and left hand sides.

According to the present invention, in performing the operation of discharging the residual gas when the use of an aerosol type atomizer is ended, when a user pushes down the push button with fingers to take a spray position, the user may perform an extremely simple and uncomplicated operation of pressing a side face of the cap body inwards to engage the side face with the movable member for spray operation and thereby to lock the movable member for spray operation with the side face and can therefore perform the operation easily and safely.

Also, according to the present invention, since contents of the container are prevented from being sprayed unless the user performs a particular operation of holding the movable member for spray operation at the spray position by pressing the side face of the cap body inwards to lock the movable member for spray operation with the side face, the problem of falsely spraying the contents inside of the container altogether when the aerosol type atomizer is used, namely in the time of normal spray, can be prevented.

BEST MODES FOR CARRYING OUT THE INVENTION

Figure 1:
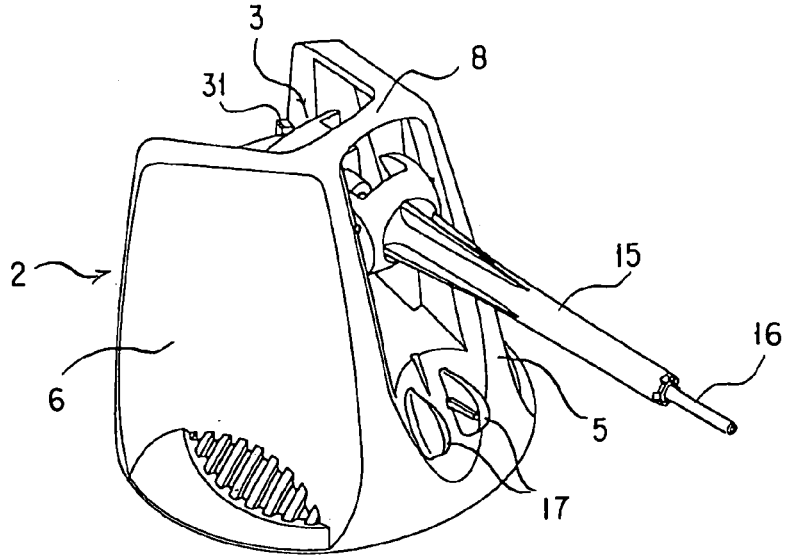
FIG. 1 is a front perspective view illustrating a head cap for an aerosol type atomizer according to the present invention.
Figure 2:
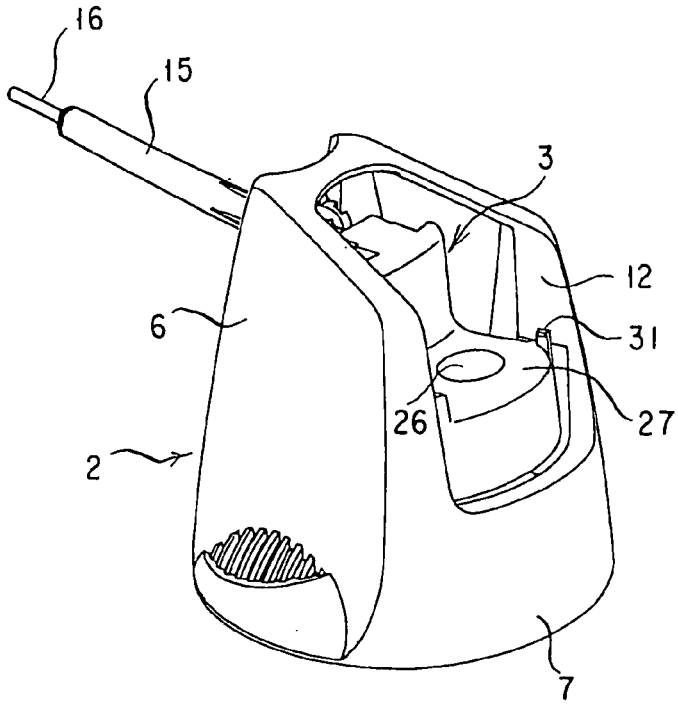
FIG. 2 is a rear perspective view illustrating the head cap for the aerosol type atomizer according to the present invention.
Figure 3:
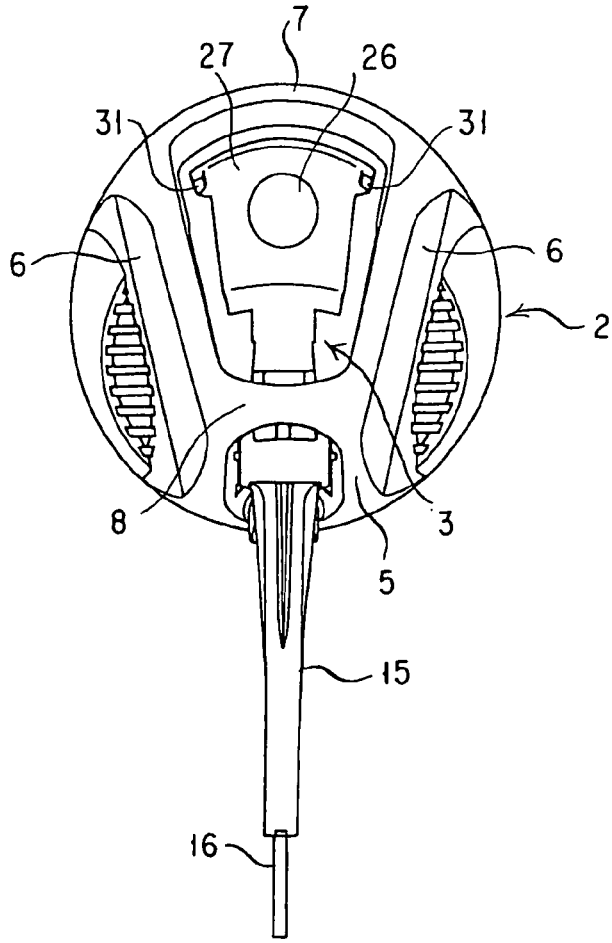
FIG. 3 is a top plan view illustrating the head cap for the aerosol type atomizer according to the present invention.
Figure 4:
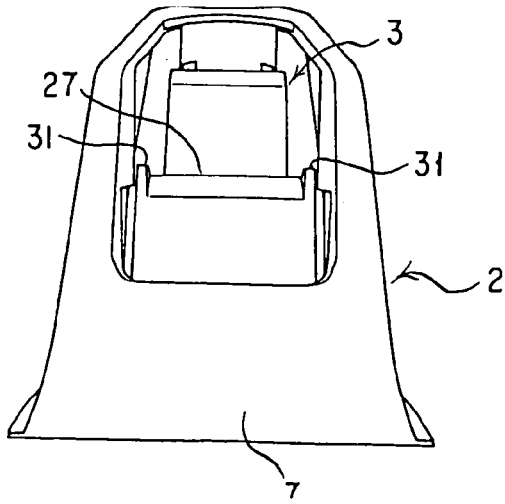
FIG. 4 is a rear view illustrating the head cap for the aerosol type atomizer according to the present invention.
Figure 5:
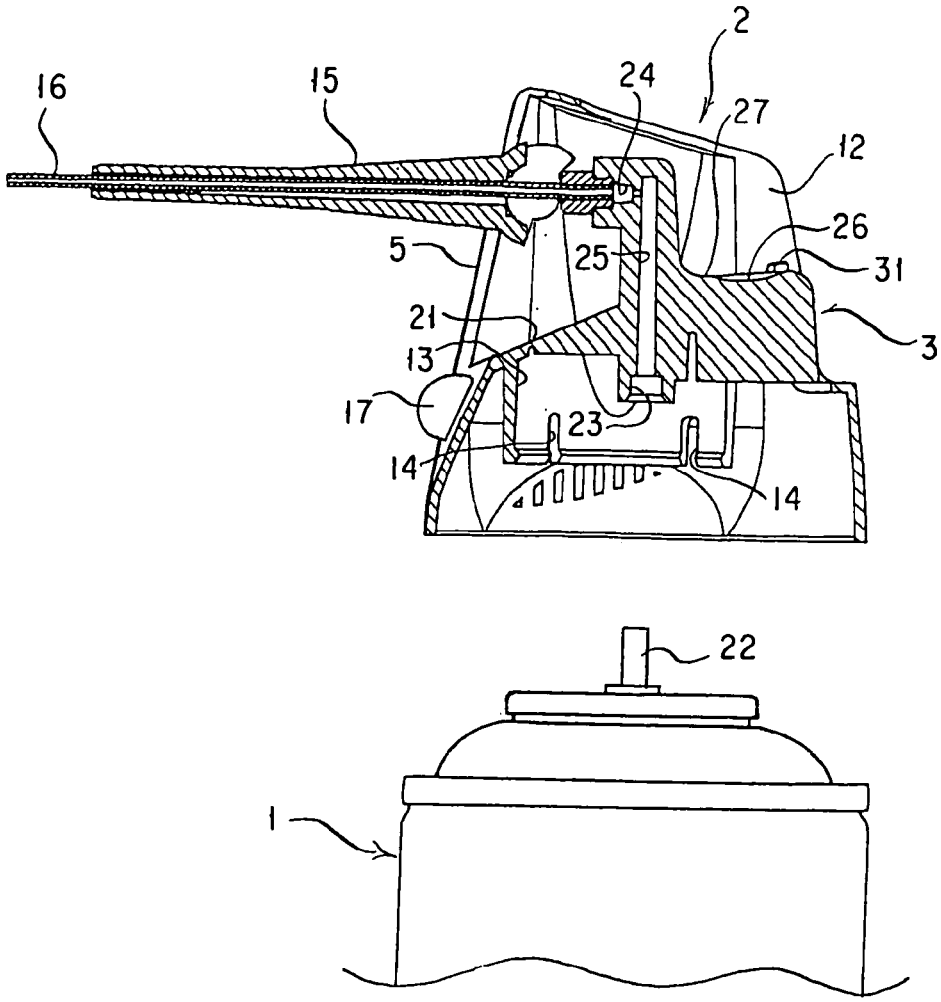
FIG. 5 is an elevational cross sectional view the head cap for the aerosol type atomizer according to the present invention.

An explanation is given in respect of an embodiment of a head cap for an aerosol type atomizer according to the present invention.

As shown in FIGS. 1 to 5, the head cap for this aerosol atomizer is basically made of a cap body 2 mounted over a top of a container 1 accommodating its contents such as a chemical in its inside, and a movable member for spray operation 3 which is disposed inside of the cap body 2, which is connected to a part of the cap body 2 and which can be pivoted and swung vertically relative to the cap body 2.

The cap body 2 comprises a front part 5 that is largely opened longitudinally, side faces 6 at its right and left hand sides that are planar for the most parts, a rear part 7 that is opened at its upper side, and a top face 8 that is opened at its rear side, the opening of the rear part 7 being continuous with that of the top face 8. Each of the side faces 6 of the right and left hand sides is made of an outer wall plate 11 and an inner wall plate 12 which is formed to droop in a rear portion of the side face 6 from its upper side to a given height from which the inner wall plate 12 is structured to open at its lower side. Also, the front part 5, the side faces 6 at the right and left hand sides and the rear part 7 are provided at their insides with a cylindrical part 13 whose rear side is cut out to become nearly C-shaped in a horizontal cross section and whose lower end is fitted with the top of the container 1. Also, the cylindrical part 13 is formed with a plurality of vertical cuts or indentations 14 extending from its lower end to ease its attachment to and detachment from the container 1.

The front part 5 of the cap body 2 is also provided at its lower section with a pair of right and left hand side retainer pieces 17 for holding a rotary guide 15 and a nozzle 16 (to be described later) between them from the right and left hand sides.

On the other hand, the movable member for spray operation 3 has its front end connected to the front part 5 of the cap body 2 via a connection 21 becoming thin in the inside of the front part 5 so that it can be swung vertically on the connection 21 relative to the cap body 2. The movable member for spray operation 3 is provided centrally at its lower end with a stem fitting part 23 for fitting with a stem 22 of the container 1 and at its upper front section with a spray port 24. And, it is formed interiorly with a fluid channel 25 extending from the stem fitting part 23 to the spray port 24. Also, the movable member for spray operation 3 is structured to be higher in its front section and lower in its rear section, and is provided at the lower section with a push button 27 having a recess 26.

Although the movable body for spray operation 3 and the cap body 2 are shown structured to be integrally connected to each other via the connection 21, this is not a limitation; the movable body for spray operation 3 and the cap body 2 may be separate bodies which may be structured to be connected to each other by a pin or the like. However, it would be easier in manufacture to structure the movable member for spray operation 3 and the cap body 2 integrally and, especially if made of, e. g., a synthetic resin material, they can be formed in a single step with a mold and can be manufactured extremely economically.

Further, the front part 5 of the cap body 2 is provided at its upper section with the rotary guide 15 in the form of a thin cylinder, which is rotatable vertically and can be locked at a position that it extends virtually horizontally and at a position that it extends downwards. And, the nozzle 16 that is flexible is inserted in the rotary guide 15, and has its rear end fitted with the spray port 24 of the movable member for spray operation 3.

Figure 6:
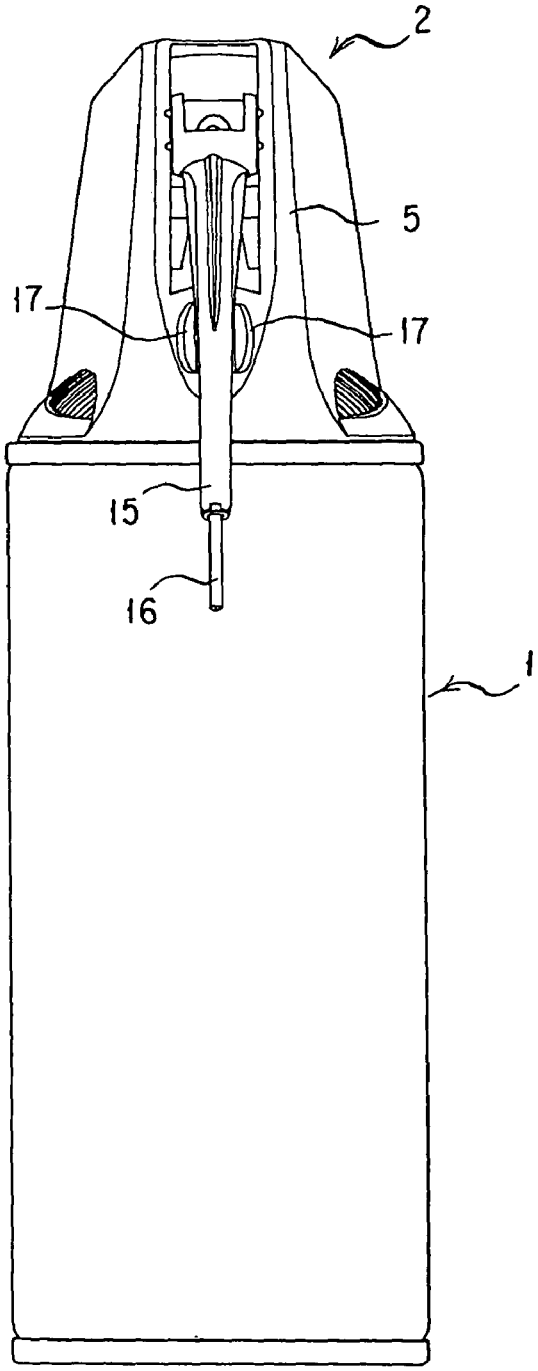
FIG. 6 is a diagram illustrating the state that the head cap for the aerosol type atomizer is stored.

In the head cap when used as for an aerosol type atomizer by mounting it over the top of the container 1, first the rotary guide 15 with the nozzle 16 is rotated upwards to position them as they extend virtually horizontally. And, pushing down the push button 27 with a finger at the rear section of the movable body for spray operation 3 will cause the movable member for spray operation 3 to lower to take its spray position and thereby the stem fitting part 23 to press down the stem 22. This will cause the contents of the container 1 to be discharged through the stem 22 under the pressure of a gas therein and then through the fluid channel 25 in the movable body for spray operation 3 and the spray port 24 and through the nozzle 16 fitted with the spray port 24 and sprayed forward and externally from the end of the nozzle 16. Also, if the aerosol type atomizer is to be stored upon stopping the spray of the contents, as shown in FIG. 6 the rotary guide 15 with the nozzle 16 is turned downwards so it extends downward, and is held between the retention pieces 17 provided at the lower section of the front part 5.

And, in this head cap for the aerosol type atomizer, the side faces 6 at the right and left hand sides of the cap body 2 are rendered elastically deformable. As a means for rendering them elastically deformable, it is conceivable to use a soft material, e. g., a soft synthetic resin material or to make thinner their thickness. However, considered synthetically, it is optimum if the head cap 2 is made of a synthetic resin material, and it is best formed integrally with the movable body for spray operation 3 from the aspect of manufacture. While it is necessary that the side faces 6 at the right and left hand sides of the cap body 2 be made elastically deformable, it is required that the front part 5, the rear part 7 and the top face 8 as the other parts of the cap body 2 or the movable member for spray operation 3 have some degree of hardness. Hence, in practice, use is made of a synthetic resin material having both some degree of hardness and elastic deformability to make up the cap body 2 and the movable member for spray operation 3 integrally formed into the head cap while largely opening the rear section of the top face 8 continuously to the upper side of the rear part 7 to make the side faces 6 at the right and left hand sides easily deformable elastically.

It should be noted here that the above structure is not a limitation; though with some added cost, the side faces 6 at the right and left hand sides may be separate from the other parts and may be made of a material that is softer.

On the other hand, the push button 27 for the movable member for spray operation 3 is provided at its right and left hand sides with upwardly projecting protrusions 31, respectively, which are made engageable with the inner wall plates 12 in the side faces 6 of the cap body 2, respectively.

Figure 7:
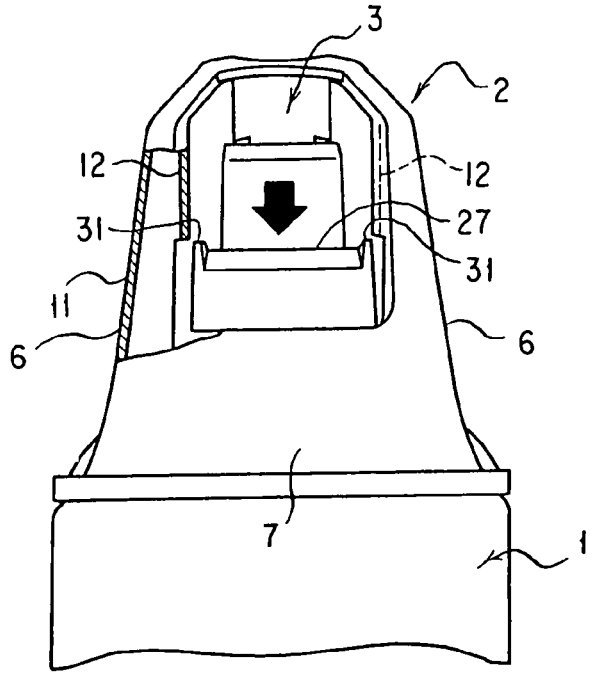
FIG. 7 is a diagram illustrating the state that the head cap for the aerosol type atomizer is being operated.
Figure 8:
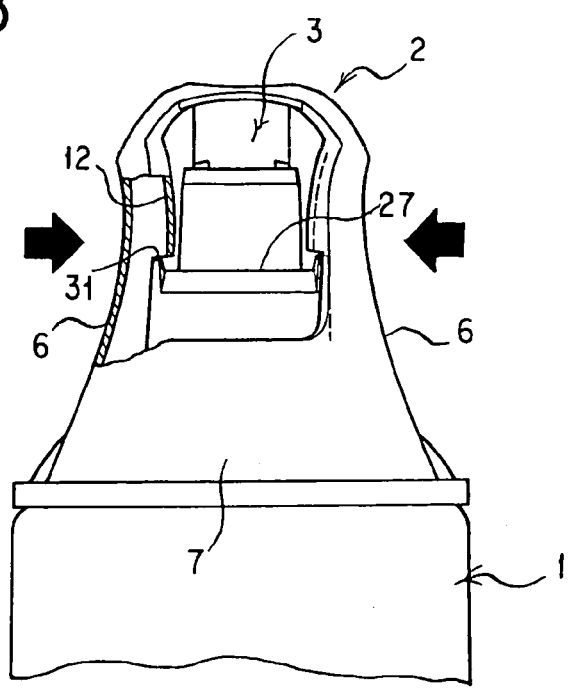
FIG. 8 is a diagram illustrating the state that the head cap for the aerosol type atomizer is being operated.
Figure 9:
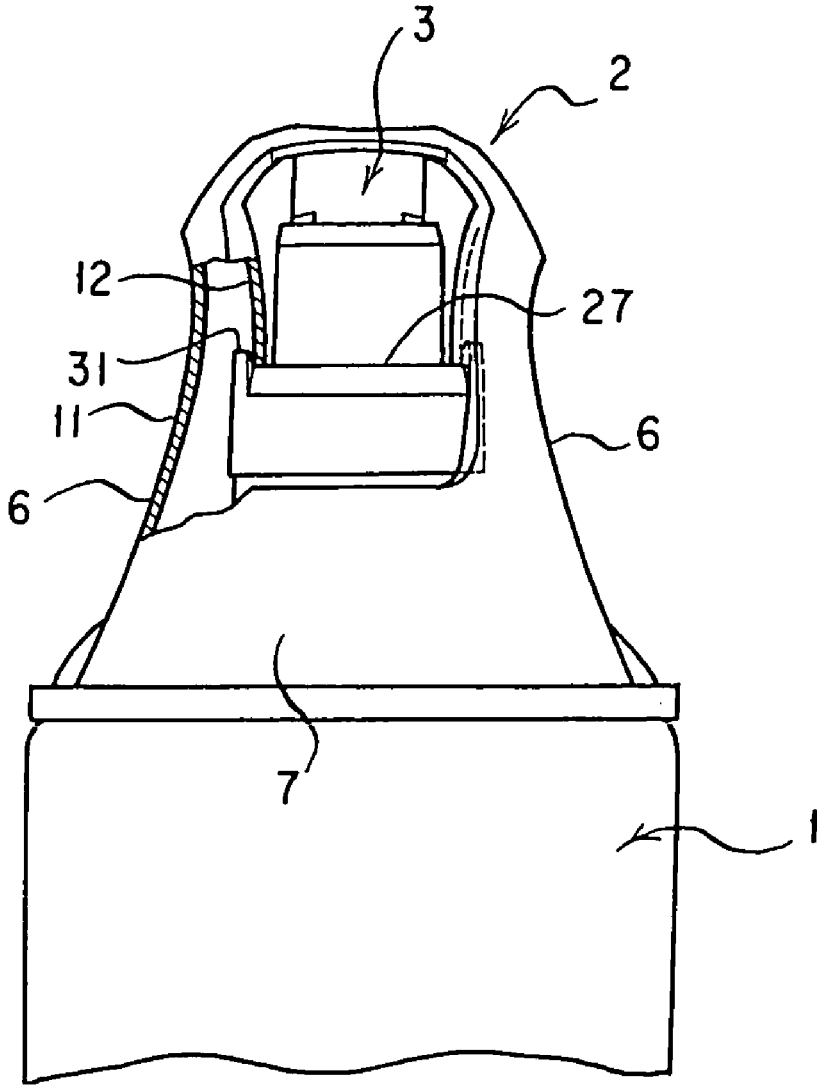
FIG. 9 is a diagram illustrating the state that the head cap for the aerosol type atomizer is being operated.
Figure 10:
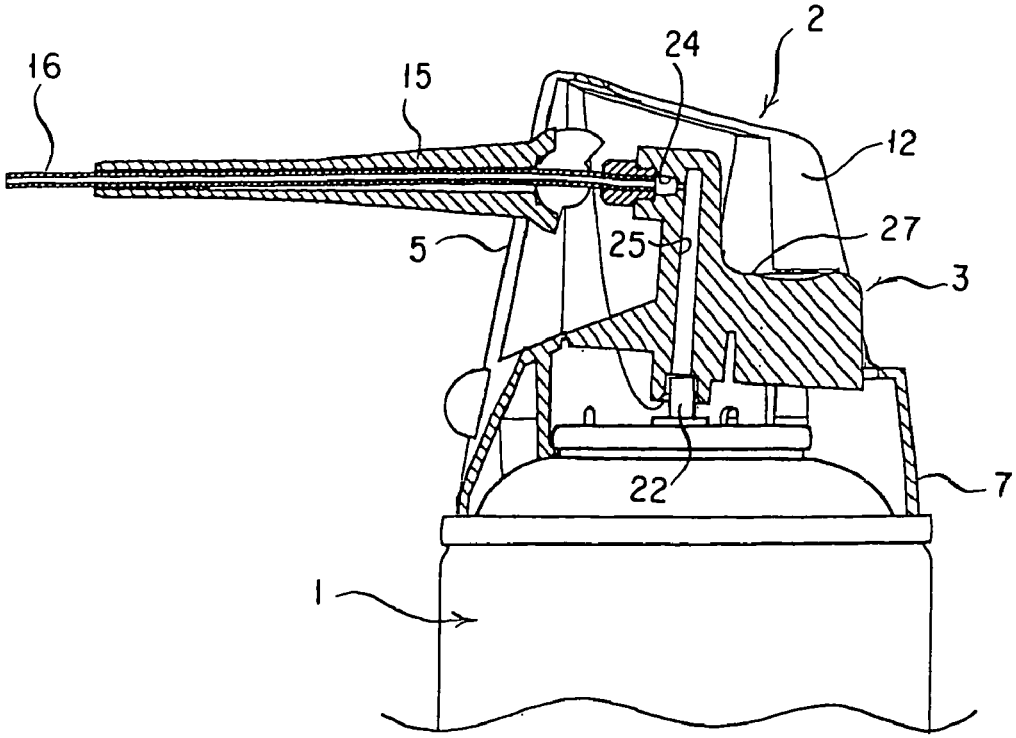
FIG. 10 is a diagram illustrating the state that the head cap for the aerosol type atomizer is being operated.

And, in such a structure, when the push button 27 of the movable member for spray operation 3 is pushed down as shown in FIG. 7 to take its spray position, the side faces 6 at the right and left hand sides of the cap body 2 which are elastically deformable are pressed inwards in a grasping manner as shown in FIG. 8 to engage the protrusions 31 provided in the push button 27 of the movable member for spray operation 3 with the inner wall plates 12 of these right and left side faces 6, respectively, whereby to lock the push button 27 of the movable member for spray operation 3 with the inner wall plates 12 of the right and left side faces 6 and then to hold the movable member for spray operation 3 so that the latter while at the spray position may not be swung upwards as shown in FIGS. 9 and 10.

In this head cap for the aerosol type atomizer, when the aerosol type atomizer is used, namely in a time of normal spray, the user while positioning the rotary guide 15 with the nozzle 16 so that they extend virtually horizontally may push down the push button 27 of the movable member for spray operation 3 with the thumb to cause the movable member for spray operation 3 to take its spray position and to spray the contents accommodated in the container 1 from the nozzle 16 fitted with the spray port 24 of the movable member for spray operation 3.

On the other hand, when the use of the aerosol type atomizer is ended, namely when the contents in the container 1 of the aerosol type atomizer are altogether sprayed and used up, the user while pushing down the push button 27 of the movable member for spray operation 3 with a finger to cause the movable member for spray operation 3 to take its spray position may press the side faces 6 at the right and left hand sides of the cap body 2 inwards in a grasping manner with fingers. And, the protrusions 31 of the push button 27 are engaged with the inner wall plates 12 of the right and left side faces 6 pressed inwards to lock the movable member for spray operation 3 with the inner wall plates 12 of the right and left side faces 6 and then to hold the movable member for spray operation 3 at its spray position. This causes the movable member for spray operation 3 to be left in the spray state and then causes the gas that remains in the container 1, namely the residual gas, to be discharged fully.

In the head cap for the aerosol type atomizer of such a construction, when the use of the aerosol type atomizer is ended, the movable member for spray operation 3 is locked with the right and left side faces 6 pressed inwards and is held at the spray position whereby the residual gas in the container 1 can be discharged fully. Moreover, the operation for discharging the residual gas is an extremely simple and uncomplicated operation that requires the user only to push down the push button 27 with a finger to take the spray position and then to press the side faces 6 at the right and left hand sides of the cap body 2 inwards in a grasping manner with fingers to engage the protrusions 31 of the push button 27 with the inner wall plates 12 of the right and left side faces 6 and then to lock the movable member for spray operation 3, and hence can be performed easily and safely to discharge the residual gas.

Also, in locking the movable member for spray operation 3, since the protrusions 31 of the push button 27 are engaged with the inner wall plates 12 and in effect are locked at the right and left hand sides, the movable member for spray operation 3 cannot be unlocked with ease, thereby allowing the residual gas to be discharged fully to the last.

Further, in locking the movable member for spray operation 3, since the inner wall plates 12 of the side faces 6 of the cap body 2 are utilized to lock the movable body for spray 3 therewith, there is no need to provide a particular locking member purposely for locking the movable member for spray operation 3. Thus, by limiting the increase of components to reduce the number of parts, and to simplify the structure, of the head cap for the aerosol type atomizer, it is possible to manufacture the head cap economically and yet easily.

Also, when the aerosol type atomizer is used, namely in a time of normal spray, the push button 27 can simply be pushed down with a finger to spray the contents accommodated in the container 1. On the other hand, when the residual gas is to be discharged, a particular operation is performed to push down the push button 27 of the movable member for spray operation 3 to take the spray position and then to press the side faces 6 at the right and left hand sides of the cap body 2 inwards in a grasping manner with fingers to engage the protrusions 31 of the push button 27 with the inner wall plates 12 of the right and left side faces 6. For this reason, unless such a particular operation to press the side faces 6 at the right and left hand sides of the cap body 2 inwards in a grasping manner with fingers to engage the protrusions 31 of the push button 27 with the inner wall plates 12 of the right and left side faces 6 and thereby to hold the movable member for spray operation 3 is performed, no time is there that the contents inside of the container 1 are altogether sprayed. Hence, the problem is eliminated that when the aerosol type atomizer is in use, namely in a time of normal spray, the contents in the container 1 come to be falsely sprayed altogether.

It may be possible to press inwards the rear part 7 of the cap body 2, in lieu of the side faces 6 of the cap body 2, to lock the movable member for spray operation 3 therewith. However, if the rear part 7 of the cap body 2 is utilized, since in a time of normal spray, the user for spray holds a finger or fingers from the rear against the push button 27 of the movable member for spray operation 3, the problem arises that by some chance the finger or fingers may then push the rear part 7 inwards to lock the movable member for spray operation 3 on the rear part 7 so that the contents inside of the container 1 may altogether be sprayed. Such a problem that the contents inside of the container 1 are altogether sprayed by a false operation in a time of normal spray no longer arises when the side faces 6 at the right and left hand sides of the cap body 2 are utilized in locking the movable member for spray operation 3 according to the present invention.

An explanation is next given in respect of an alternative embodiment of the head cap for the aerosol type atomizer according to the present invention. The alternative embodiment is basically identical to the embodiment mentioned above except that the manner in which to engage the movable member for spray operation 3 with the side faces 6 of the cap body is a little different.

Figure 11:
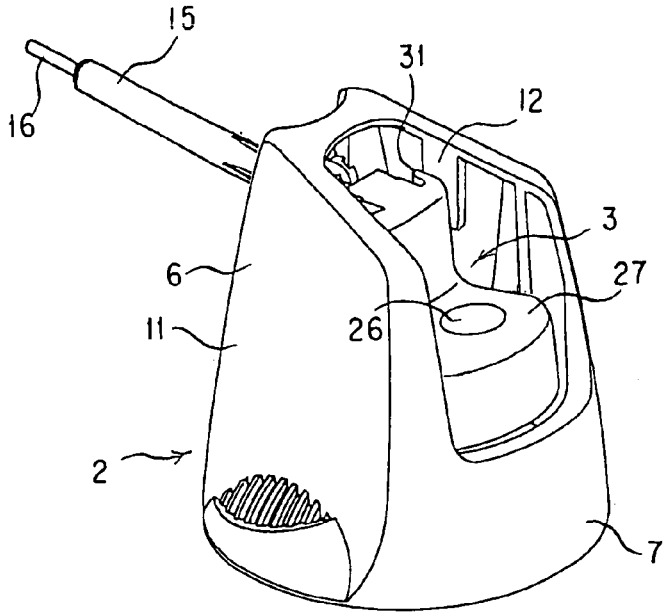
FIG. 11 is a rear perspective view illustrating a head cap for an aerosol atomizer in an alternative embodiment according to the present invention.
Figure 12:
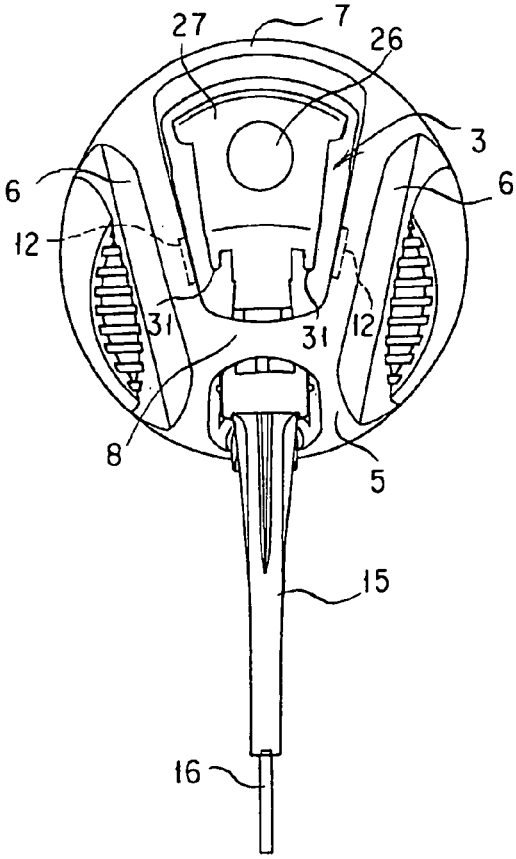
FIG. 12 is a top plan view illustrating the head cap for the aerosol type atomizer in the alternative embodiment according to the present invention.

This is illustrated in FIG. 11 in which the inner wall plates 12 in the side faces 6 at the right and left hand sides of the cap body 2 are each shown to be in the form of a tongue that droops virtually centrally of front and rear, from the upper end of each of the side faces 6. On the other hand, the movable member for spray operation 3 as shown in FIG. 12 is provided in its section higher in elevation where it projects right- and leftwards at the rear end with a pair of forward projecting protrusions 31, respectively. The right- and leftward protrusions 31 are made engageable with the tongue shaped inner wall plates 12 in the side faces 6 of the cap body 2, respectively.

Figure 13:
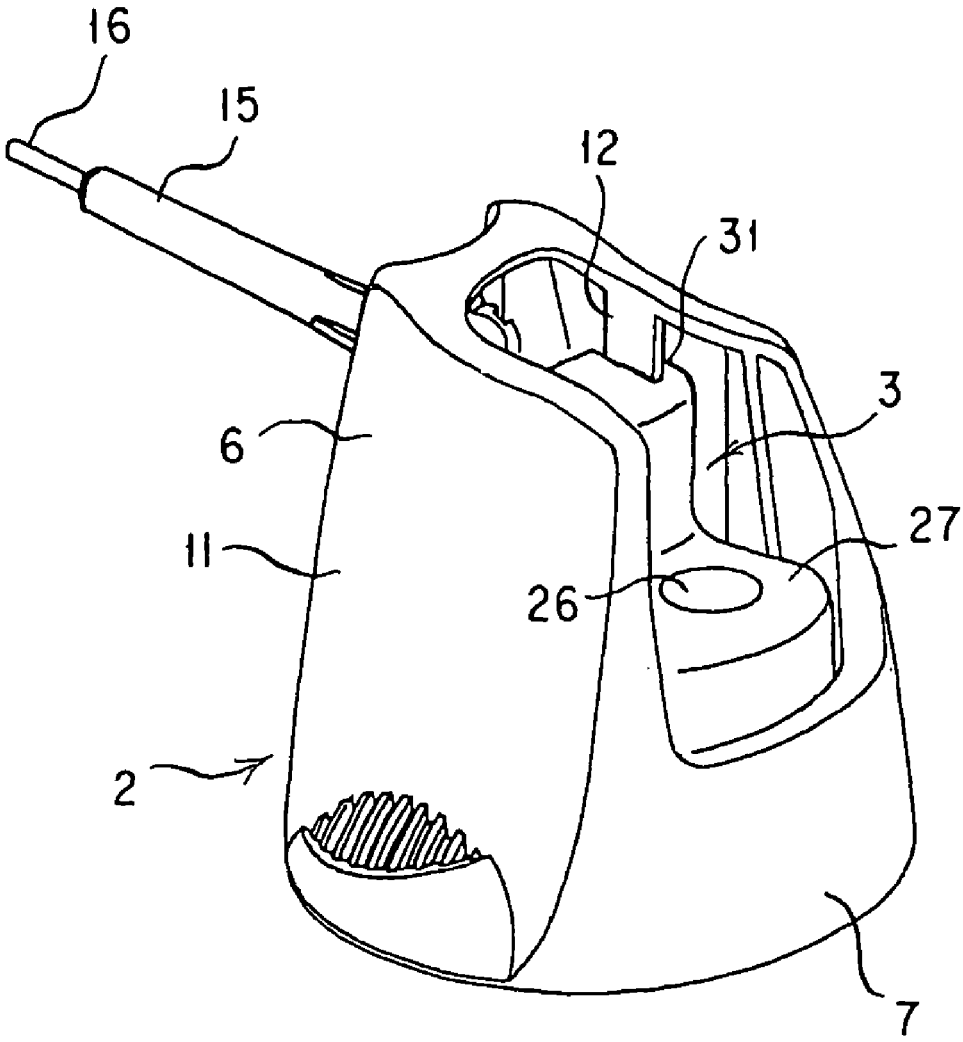
FIG. 13 is a diagram illustrating the state that the head cap for the aerosol type atomizer in the alternative embodiment of the present invention is being operated.

Accordingly, when the push button 27 of the movable member for spray operation 3 is pushed down to take the spray position, the side faces 6 at the right and left hand sides of the cap body 2 which are elastically deformable can be pressed inwards in a grasping manner with fingers to engage, as shown in FIG. 13, the protrusions 31 provided in the movable member for spray operation 3 with the inner wall plates 12 in the side faces 6 at the left hand sides, respectively, whereby to lock the movable member for spray operation 3 with the inner wall plates 12 in the side faces 6 at the right and left hand sides and then to hold the movable member for spray operation 3 at the spray position while preventing the same from being vertically swung.

This causes, as in the embodiment mentioned previously, the movable body for spray operation 3 when the use of the aerosol type atomizer is ended to be locked with the side faces 6 at the right and left hand sides pressed inwards and the same to be held at the spray position and then the residual gas in the container 1 to be discharged fully.

It should be noted here that the head cap for the aerosol type atomizer according to the present invention is not considered to be limited only to what have been shown and described. For example, the engagement of the movable member for spray operation 3 with the inner wall plates 12 in the side faces 6 of the cap body 2 is not limited to the embodiments described and may be made at other sites. Further, while the engagement is shown to be made at both right and left hand sides, the engagement may be made only at one of the right and left hand sides if the engagement is secure to hold the movable member for spray operation at the spray position.

Also, while the side faces 6 of the cap body 2 is shown and described to comprise the outer wall plates 11 and the inner wall plates 12, the same may comprise the outer wall plates 11 only, which may be formed with engagements in the form of holes or hooks with which the protrusions 31 provided in the movable member for spray operation 3 may be engaged.

Figure 14:
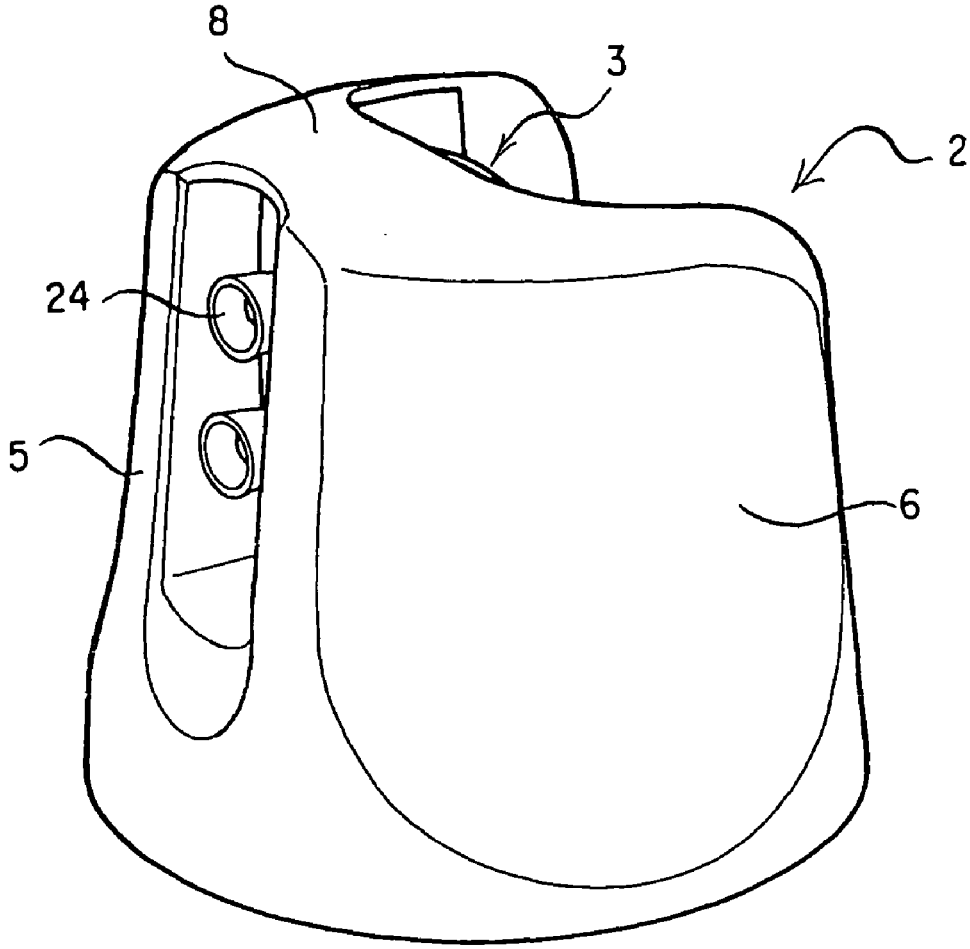
FIG. 14 is a front perspective view illustrating a head cap for an aerosol type atomizer in a further alternative embodiment of the present invention.

Further, the cap body 2 and the movable member for spray operation 3 are not limited to the structures shown and described. For example, while the movable member for spray operation 3 is shown and described to have the rotary guide 15 rotatable vertically in the front part 5 and the nozzle 16 fitted with the spray port 24 for vertical rotation with the rotary guide 15, it may be without such rotary guide 15 and nozzle 16 and may be of the type with the spray port 24 for direct spray as shown in FIG. 14.

What is claimed is:

1. A head cap for an aerosol type atomizer, comprising:

a cap body mounted over a top of a container accommodating contents; and a movable member for spray operation disposed inside of the cap body, the movable member for spray operation comprising a fluid channel extending from a stem fitting part for fitting with a stem to a spray port, and a push button which is adapted to be pushed down to a spray position to spray the contents of the container from the spray port via the fluid channel;

wherein the cap body comprises right and left side faces at right and left hand sides thereof, wherein the side faces are elastically deformable, and wherein when the push button of the movable member for spray operation is pushed down to the spray position, pressing the right and left side faces inwards in a grasping manner locks the movable member for spray operation to hold the movable member for spray operation at the spray position;

wherein each of the right and left side faces comprises an outer wall plate and an inner wall plate which is formed to droop in a rear portion of the side face from an upper side to a given height from which the inner wall plate is structured to open at a lower side;

wherein the push button of the movable member for spray operation is provided at right and left hand sides thereof with right and left upwardly projecting protrusions, respectively, which are engageable with the inner wall plates of the side faces of the cap body, respectively; and wherein when the push button of the movable member for spray operation is pushed down to the spray position, pressing the elastically deformable right and left side faces of the cap body inwards in a grasping manner causes the protrusions of the push button to be engaged with the inner wall plates of the right and left side faces, respectively, to lock the movable member for spray operation with the inner wall plates of the right and left side faces and to hold the movable member for spray operation at the spray position.

2. A head cap for an aerosol type atomizer, comprising:

a cap body mounted over a top of a container accommodating contents; and a movable member for spray operation disposed inside of the cap body, the movable member for spray operation comprising a fluid channel extending from a stem fitting part for fitting with a stem to a spray port, and a push button which is adapted to be pushed down to a spray position to spray the contents of the container from the spray port via the fluid channel;

wherein the cap body comprises right and left side faces at right and left hand sides thereof, wherein the side faces are elastically deformable, and wherein when the push button of the movable member for spray operation is pushed down to the spray position, pressing the right and left side faces inwards in a grasping manner locks the movable member for spray operation to hold the movable member for spray operation at the spray position;

wherein each of the side faces of the right and left hand sides comprises an outer wall plate and an inner wall plate, wherein each of the inner wall plates is in the form of a tongue that droops virtually centrally, in a front-to-rear direction, from an upper end of a respective one of the side faces;

wherein the movable member for spray operation comprises a portion that is higher in elevation than the push button of the movable member for spray operation, said portion comprises rightward and leftward projections at a rear end of said portion, and forward projecting protrusions are provided to the rightward and leftward projections, respectively;

wherein when the push button of the movable member for spray operation is pushed down to the spray position, pressing the elastically deformable right and left side faces of the cap body inwards in a grasping manner causes the forward projecting protrusions of the movable member for spray operation to be engaged with the inner wall plates of the right and left side faces, respectively, to lock the movable member for spray operation with the inner wall plates of the right and left side faces and to hold the movable member for spray operation at the spray position while preventing the movable member for spray operation from being swung vertically.

* * * * *